United States Patent [19]

Bosshard

[11] Patent Number: 4,539,890

[45] Date of Patent: Sep. 10, 1985

[54] CARTRIDGE INFEED APPARATUS FOR AUTOMATIC FIRING WEAPONS

[75] Inventor: Werner Bosshard, Zurich, Switzerland

[73] Assignee: Werkzeugmaschinenfabrik Oerlikon-Bührle AG, Zurich, Switzerland

[21] Appl. No.: 524,071

[22] Filed: Aug. 17, 1983

[30] Foreign Application Priority Data

Sep. 3, 1982 [CH] Switzerland ..... 5238/82

[51] Int. Cl.[3] ..... F41D 9/00; F41D 11/14

[52] U.S. Cl. ..... 89/33.2; 89/33.04

[58] Field of Search ..... 89/33.04, 33.2, 33.14, 89/33.16, 33.25, 33.01

[56] References Cited

U.S. PATENT DOCUMENTS

| | | | |
|---|---|---|---|
| 671,062 | 4/1901 | Anderson | 89/33.2 X |
| 709,880 | 9/1902 | DeKnight | 89/33.2 X |
| 2,486,878 | 11/1949 | Rataiczak | 89/33.2 |
| 2,529,822 | 11/1950 | Stacey | 89/33.01 X |
| 2,669,160 | 2/1954 | Maillard | 89/33.2 |
| 2,875,671 | 3/1959 | Robinson | 89/33.2 |
| 3,039,364 | 6/1962 | Barr | 89/33.2 |
| 3,221,603 | 12/1965 | Lochhead | 89/33.01 X |
| 3,455,204 | 7/1969 | Stoner | 89/33.2 |
| 4,280,392 | 7/1981 | Hürlemann | 89/33.2 X |

FOREIGN PATENT DOCUMENTS

| | | |
|---|---|---|
| 1066513 | 1/1954 | France . |
| 1328033 | 6/1962 | France . |
| 253497 | 3/1948 | Switzerland . |
| 579763 | 7/1976 | Switzerland . |

*Primary Examiner*—David H. Brown

*Attorney, Agent, or Firm*—Werner W. Kleeman

[57] ABSTRACT

In an automatic firing weapon containing a forwardly and rearwardly travelling breechblock each cartridge is engaged by a breechblock edge of the forwardly travelling breechblock and pushed into the weapon or gun barrel. As soon as the breechblock is in its rearmost position a cartridge is moved through a cartridge feedway or infeed channel into a position from which the same can be pushed into the weapon barrel by means of the breechblock. Since the breechblock assumes its rearmost position only for a brief time period when the firing weapon has a high firing rate or cadence, large forces are required for accelerating the cartridge which is to be infed. Hence, the springs which have been heretofore used are replaced by an insertion lever and a back-up latch or pawl, the insertion or placement movement of the insertion lever being controlled by a control cam of the rearwardly travelling breechblock.

5 Claims, 4 Drawing Figures

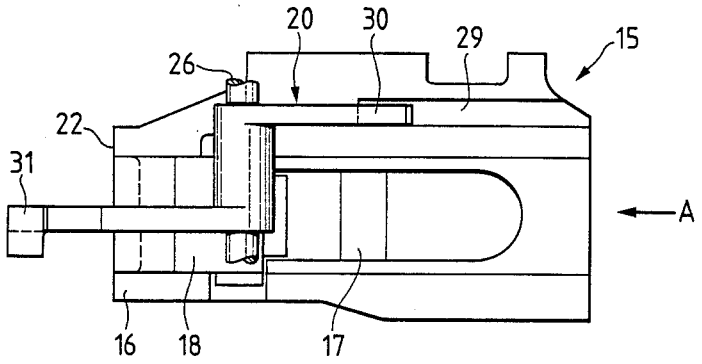
FIG. 3
FIG. 4
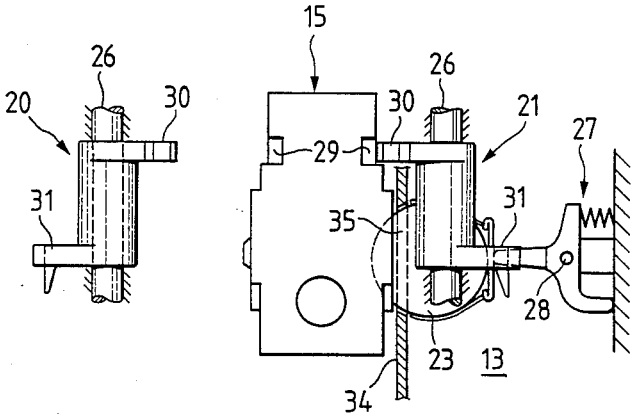

CARTRIDGE INFEED APPARATUS FOR AUTOMATIC FIRING WEAPONS

BACKGROUND OF THE INVENTION

The present invention relates to a new and improved cartridge feeding or infeed apparatus for an automatic firearm or firing weapon.

In its more specific aspects, the present invention relates to a new and improved construction of a cartridge feeding or infeed apparatus for an automatic firearm or firing weapon containing a cartridge infeed channel or feedway, one side wall of which comprises an appropriately configured slot extending parallel to the lengthwise axis of the firearm. A cartridge which is present in the cartridge infeed channel or feedway and which is to be pushed into the weapon barrel by means of the breechblock partially projects into the slot. Cartridge infeed means are provided for feeding the cartridge into the slot and for holding the same therein.

In a cartridge feeding apparatus of this kind as known, for example, from Swiss Pat. No. 579,763, German Pat. No. 2,521,034 and U.S. Pat. No. 3,973,467, there is present a conveyor channel or passage, the side wall of which contains a slot which extends parallel to the lengthwise axis of the gun. A cartridge which is present in the conveyor channel or passage and which is to be pushed into the gun barrel by means of the breechblock partially extends into the slot. Two guiding arms of cartridge infeed means press the aforementioned cartridge perpendicularly with respect to the cartridge conveying direction and towards the aforementioned slot by means of a spring. On the sides of the guiding arms located opposite to the cartridge there is arranged a pivotable latch or pawl containing a cam with a control surface which serves to operate the latch. By means of this latch the guiding arms are backed-up while the cartridge is pushed-in.

The aforementioned known cartridge infeed apparatus has the following disadvantages. Only very little time is available for feeding the cartridge into the aforementioned slot. The cartridge only can be inserted into that slot when the breechblock is located at the region of its rearmost position. Only as long as the breechblock is located to the rear of the cartridge can the cartridge be inserted into the slot in such a manner that it is reliably engaged by the breechblock head and inserted into the gun barrel. However, the higher the firing rate or firing cadence of the firearm, the shorter is the time available for bringing the cartridge into the desired position. Thus, under these circumstances it is insufficient for proper operation of the weapon that two guiding arms press the cartridge perpendicular to the cartridge conveying direction and towards the aforementioned slot by means of a spring. The acceleration forces required to displace the cartridge in such a short period of time are too large, so that even a powerful spring no longer suffices.

SUMMARY OF THE INVENTION

Therefore, with the foregoing in mind it is a primary object of the present invention to provide a new and improved cartridge infeed or feeding apparatus for an automatic firearm or firing weapon which is not afflicted with the aforementioned drawbacks and limitations heretofore discussed.

Another and more specific object of the present invention is directed to the provision of a new and improved cartridge infeed apparatus for an automatic firing weapon which operates without a spring force in order to feed the cartridge into the slot from which the same can be pushed into the weapon barrel by means of the breechblock.

Now in order to implement these and still further objects of the invention, which will become more readily apparent as the description proceeds, the cartridge infeed apparatus of the present development is manifested by the features that, the cartridge infeed means comprises a two-armed or double-arm insertion lever, at one arm of which the cartridge is supported and the other arm of which is supported at a control cam of the breechblock. The cartridge insertion or placement lever is pivotably mounted at the firing weapon, and the shape of the control cam is selected such that the insertion lever presses the cartridge into the slot with one arm thereof when the breechblock is in its rearmost position.

The cartridge infeed apparatus according to the invention has the advantage that the cartridge is positively pressed into the slot during the return travel of the breechblock by means of the insertion lever and is reliably located at the correct position when the cartridge is pushed into the gun barrel by means of the edge of the breechblock.

Preferably, the cartridge infeed means comprises a back-up latch or pawl which backs-up and engages behind the cartridge as soon as the same is placed into the slot by means of the insertion or placement lever.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 3 is a side view of part of the automatic firearm or firing weapon containing the cartridge infeed apparatus shown in FIG. 2; and FIG. 4 is a view of the automatic firing weapon containing the cartridge infeed apparatus as seen looking in the direction of the arrow A in FIG. 3.

DETAILED DESCRIPTION OF THE PREFERRED EMBODIMENTS

Figure 1:
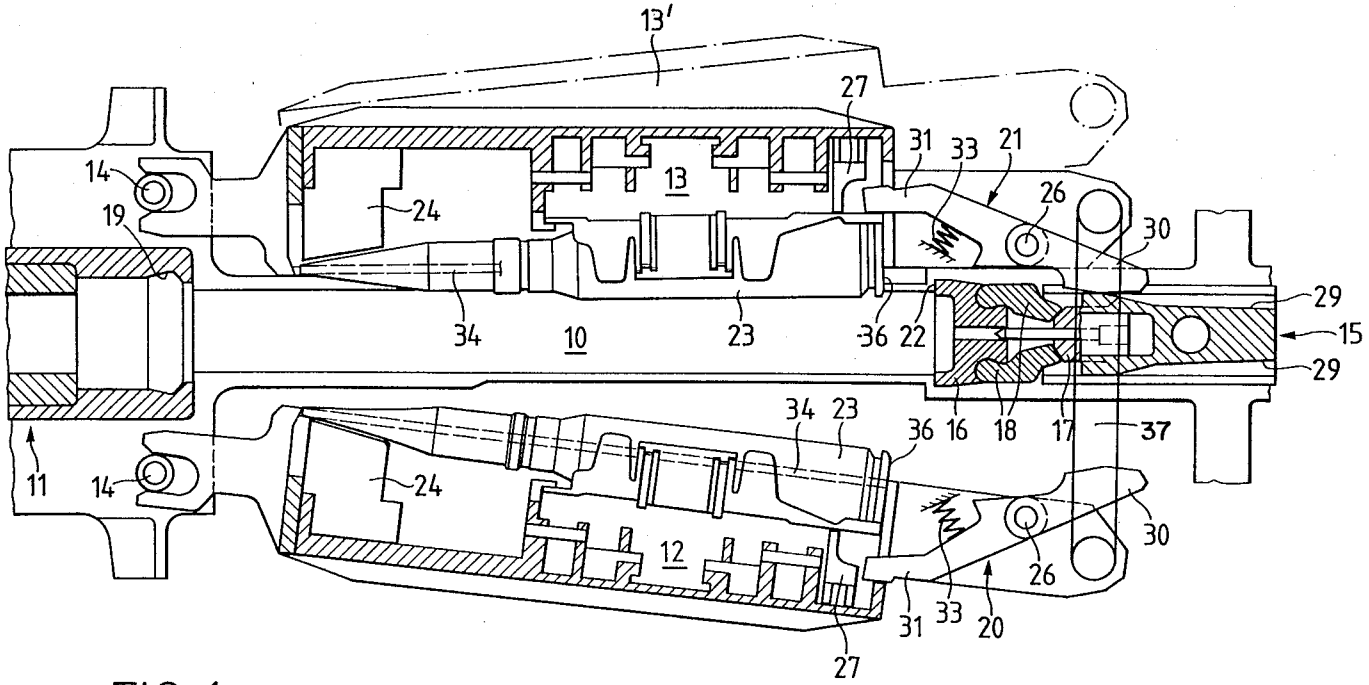
FIG. 1 is a fragmentary longitudinal section through part of an automatic firearm or firing weapon containing the cartridge infeed or feeding apparatus according to the invention.

Describing now the drawings, it is to be understood that only enough of the construction of the cartridge infeed or feeding apparatus has been shown as needed for those skilled in the art to readily understand the underlying principles and concepts of the present development, while simplifying the showing of the drawings. Turning attention now specifically to FIGS. 1 and 2, there has been illustrated in longitudinal section part of the weapon housing 10 of a firearm or firing weapon as well as part of the weapon or gun barrel 11. Two cartridge infeed channels or feedways 12 and 13 are pivotably mounted at the weapon housing 10 so as to be pivotable about pivot pins 14. The cartridge infeed channel or feedway 12 is shown in an outwardly pivoted position, so that no cartridges can be fed to the firing weapon from this cartridge infeed channel 12. Contrary thereto, the cartridge infeed channel or feedway 13 is shown located in its operative position, so that the cartridges from the cartridge infeed channel 13 can be pushed into the weapon or gun barrel 11. The outwardly pivoted position of the cartridge infeed channel or feedway 13 is indicated by dash-dotted lines and referenced by reference character 13'. A schematically illustrated conventional switching device 37 insures that one or the other cartridge infeed channel 12 or 13 always is located in the operative position while at the same time the other cartridge infeed channel 13 or 12 is outwardly pivoted.

A breechblock 15 is displaceably mounted in the weapon housing 10. In FIG. 1 the breechblock 15 is shown in its rearmost position and in FIG. 2 it is shown in its forwardmost position.

The breechblock 15 contains a breechblock head 16, a control member 17 as well as two locking or blocking members 18. The control member 17 is displaceably arranged within the breechblock head 16. In the forwardmost position of the breechblock 15 the control member 17 protrudes between the two locking members 18 and presses the same into recesses 19 formed in the weapon or gun barrel 11, so that the breechblock head 16 is locked to the gun barrel 11. In the rearmost position of the breechblock 15 the control member 17 is located to the rear of the locking members 18, and thus, the breechblock head 16 is unlocked. The displacement of the breechblock 15 is effected in conventional manner by a suitable recoil spring (not shown) and by gas pressure. Also the cartridge belts holding the cartridges 23 are conveyed or fed in the usual manner in the cartridge infeed channels or feedways 12 and 13. Since the mechanism for displacing the breechblock and the cartridge belt conveyors are of conventional design they are not here described in any particular detail, especially since the same is unimportant for understanding the invention and does not relate to the specific subject matter of the present invention.

Figure 2:
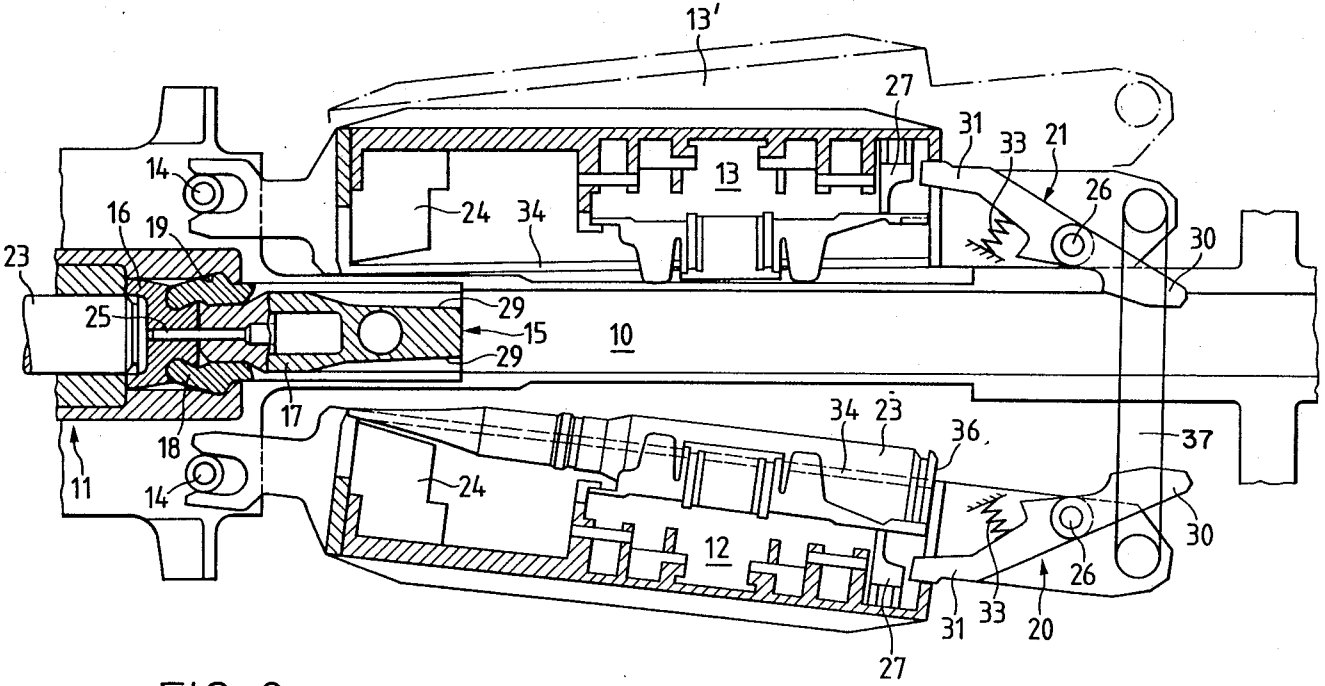
FIG. 2 is a longitudinal section of the automatic firing weapon including the cartridge infeed apparatus as shown in FIG. 1, but depicted at a different moment of time during the infeed of the cartridge.

When the breechblock 15 is displaced from its rearmost to its forwardmost position, i.e. from the right to the left in FIGS. 1 and 2, the breechblock 15 impacts against the base or bottom 36 of the cartridge 23 with its breechblock edge 22 when the cartridge 23 is located in the cartridge infeed channel 13, and which cartridge 23 also is located in a slot 35 of a side wall 34 of such cartridge infeed channel 13, as best seen by referring to FIG. 4. The lengthwise axis of the cartridge 23 is inclined relative to the axis of the firing weapon as illustrated in FIGS. 1 and 2. The cartridge 23 is deflected at a deflector latch or pawl 24 and pushed into the weapon or gun barrel 11. Subsequently, the cartridge 23 is ignited by the firing or ignition pin 25 of the control member 17.

When the cartridge 23 is pushed by a spring into the slot or opening 35 (see FIG. 4) in the side wall 34 of the cartridge infeed channel 13, there exists the danger in the known cartridge infeed or feeding apparatus that the spring is not capable of timely and completely pressing the cartridge 23 into the slot 35. Consequently, the cartridge 23 could slip-off from the edge 22 of the breechblock 15 during the forward travel thereof and could become clamped or bind between the breechblock 15 and the weapon or gun barrel 11. Hence, heretofore as powerful springs as possible have been employed to prevent such undesired slip-off of the cartridge 23. However, the time available to press the cartridge 23 into the slot 35 is so short with increasing firing rate or cadence of the weapon that a spring is no longer able to timely and reliably press the cartridge 23 into the slot 35.

According to the invention, therefore, insertion or placement levers 20 and 21 and back-up latches or pawls 27 are pivotably mounted about pivot shafts or axes 26 and 28, respectively, at each cartridge infeed channel 12 and 13. In the operative position of the cartridge infeed channel 12 or 13 the two-armed or double-arm insertion lever 20 or 21 is supported with one arm 30 thereof at a control cam 29 of the breechblock head 16, as shown in FIG. 1 for the insertion lever 21. By means of the other arm 31 of the insertion lever 20 or 21 the cartridge 23 is pressed into the slot 35, see also FIG. 4. When the breechblock head 16 is located in its rearmost position, the momentarily operative insertion or placement lever 20 or 21 is supported at the highest place of the control cam 29 formed at the breechblock head 16 by means of its arm 30. In this position the cartridge 23 is pushed by the arm 31 of the effective insertion lever 20 or 21 to such an extent towards the lengthwise axis of the firing weapon, i.e. into the slot 35, that the back-up latch 27 will latch or lock as will be evident from FIG. 4. A spring 33, which is secured to a housing at the cartridge infeed channel 12 or 13 (see FIG. 1), tends to urge and bias the insertion lever 20 or 21 with its arm 30 against the control cam 29. Thus, the momentarily effective insertion lever 20 or 21 ensures that the cartridge 23 will be completely pushed into the slot 35, and thus, has assumed the position required for insertion into the gun barrel 11 before the breechblock head 16 abuts the bottom 36 of the cartridge 23 with its breechblock edge 22 when travelling forwardly from its rearmost position. The back-up or engaging latch 27 ensures that the cartridge 23 no longer can slip-off from the breechblock edge 22 of the breechblock 15 during such time that the cartridge 23 is being pushed into the weapon or gun barrel 11.

While there are shown and described present preferred embodiments of the invention, it is to be distinctly understood that the invention is not limited thereto, but may be otherwise variously embodied and practiced within the scope of the following claims. Accordingly,

I claim:

1. A cartridge infeed apparatus for an automatic firing weapon having a weapon barrel, comprising:

a breechblock displaceable between a rearmost position and a forwardmost position;

at least one cartridge infeed channel having a side wall;

said side wall possessing a slot which extends substantially parallel to a lengthwise axis of the firing weapon and into which slot there partially extends a cartridge located in said cartridge infeed channel;

cartridge infeed means for feeding a cartridge into said slot and holding the same therein so as to partially protrude into said slot when placed in a position for being pushed into said weapon barrel by means of said breechblock;

said cartridge infeed means comprising a two-armed insertion lever;

a control cam provided for said breechblock;

said cartridge being supported at one arm of said two-armed insertion lever and the other arm of said two-armed insertion lever being supported at said control cam;

means for pivotably mounting said two-armed insertion lever relative to said firing weapon; and said control cam being structured such that said two-armed insertion lever presses said cartridge into said slot with said one arm thereof when said breechblock is in said rearmost position.

2. The cartridge infeed apparatus as defined in claim 1, wherein:

said breechblock contains a breechblock edge; and said control cam having a configuration structured such that said two-armed insertion lever releases said cartridge when said breechblock edge abuts said cartridge at a bottom region thereof.

3. The cartridge infeed apparatus as defined in claim 1, wherein:

two said cartridge infeed channels are provided, each having one said side wall and one said slot extending substantially parallel to the lengthwise axis of said firing weapon;

two said cartridge infeed means are provided, each operatively associated with a respective one of said two cartridge infeed channels; and switching means provided for said two cartridge infeed channels for displacing said two cartridge infeed channels such as to selectively alternatively assume an operative position.

4. The cartridge infeed apparatus as defined in claim 1, wherein:

said cartridge infeed means further comprises back-up latch means for engaging behind said cartridge when the same is placed by said insertion lever into said slot; and means for pivotably mounting said back-up latch means relative to said firing weapon.

5. The cartridge infeed apparatus as defined in claim 4, further including:

means for pivotably mounting said at least one cartridge infeed channel at said firing weapon; and said two-armed insertion lever and said back-up latch means being pivotably mounted to said at least one cartridge infeed channel.

* * * * *